US009217961B2

(12) United States Patent
Kaneko et al.

(10) Patent No.: US 9,217,961 B2
(45) Date of Patent: Dec. 22, 2015

(54) ENDLESS BELT FOR IMAGE FORMING DEVICE AND IMAGE FORMING DEVICE HAVING THE SAME

(71) Applicants: KABUSHIKI KAISHA TOSHIBA, Tokyo (JP); TOSHIBA TEC KABUSHIKI KAISHA, Tokyo (JP)

(72) Inventors: Yoshiaki Kaneko, Shizuoka (JP); Kimiaki Furukawa, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/186,674

(22) Filed: Feb. 21, 2014

(65) Prior Publication Data

US 2014/0241762 A1 Aug. 28, 2014

(30) Foreign Application Priority Data

Feb. 27, 2013 (JP) ..... 2013-037434

(51) Int. Cl.
*G03G 15/16* (2006.01)

(52) U.S. Cl.
CPC ..... *G03G 15/162* (2013.01); *G03G 2215/0132* (2013.01)

(58) Field of Classification Search
CPC ..... G03G 15/162; G03G 15/2053; G03G 2215/00151
USPC ..... 399/302, 308, 329
See application file for complete search history.

(56) References Cited

U.S. PATENT DOCUMENTS

2008/0003024 A1* 1/2008 Sawai ..... 399/308

FOREIGN PATENT DOCUMENTS

| | | | |
|---|---|---|---|
| JP | UH07051307 | A | 11/1995 |
| JP | H11219046 | A | 8/1999 |
| JP | 2005316028 | A | 11/2005 |
| JP | 2008-170715 | A | 7/2008 |
| JP | 2010-002659 | A | 1/2010 |

OTHER PUBLICATIONS

Machine Translation of JP H11-219046 A obtained on Dec. 31, 2014.*
Machine Translation of JP 2008-170715 A obtained on Dec. 31, 2014.*
Japanese Office Action dated May 27, 2014, filed in Japanese counterpart Application No. 2013-037434, 7 pages (with translation).

* cited by examiner

*Primary Examiner* — Gregory H Curran
(74) *Attorney, Agent, or Firm* — Patterson & Sheridan, LLP

(57) ABSTRACT

An endless belt for an image forming device includes a base member that is shaped in a loop and is to be rotated around a center of the loop, and a reinforcement tape that is attached to a side of the base member, has two ends that are overlapped with each other, and has a bonding portion between the two ends in the overlapped portion. The bonding portion has an outer portion, an inner portion and a center portion between the inner and outer portions. A length of the center portion in a rotating direction of the base member is greater than a length of the inner portion and a length of the outer portion.

18 Claims, 4 Drawing Sheets

ENDLESS BELT FOR IMAGE FORMING DEVICE AND IMAGE FORMING DEVICE HAVING THE SAME

CROSS-REFERENCE TO RELATED APPLICATION

This application is based upon and claims the benefit of priority from Japanese Patent Application No. 2013-037434, filed Feb. 27, 2013, the entire contents of which are incorporated herein by reference.

FIELD

Embodiments described herein relate generally to an endless belt used for image forming device and an image forming device having such an endless belt for forming an image.

BACKGROUND

One type of an image forming device includes an endless belt such as an intermediate transfer belt, a fixing belt, and a sheet conveyor belt. One example of the endless belt includes a belt base member and a reinforcement tape on outer edge of the belt base member. The ends of the reinforcement tape are typically bonded together. However, because the bonded portion of the reinforcement tape has a higher rigidity than other portions of the reinforcement tape, the bonded portion of the reinforcement tape may damage the belt base material when the bonded portion is repeatedly bent and extended in accordance with the rotation of the endless belt.

DETAILED DESCRIPTION

In general, according to one embodiment, an endless belt for an image forming device includes a base member that is shaped in a loop and is to be rotated around a center of the loop, and a reinforcement tape that is attached to a side of the base member, has two ends that are overlapped with each other, and has a bonding portion between the two ends in the overlapped portion. The bonding portion has an outer portion, an inner portion and a center portion between the inner and outer portions. A length of the center portion in a rotating direction of the base member is greater than a length of the inner portion and a length of the outer portion.

Figure 1:
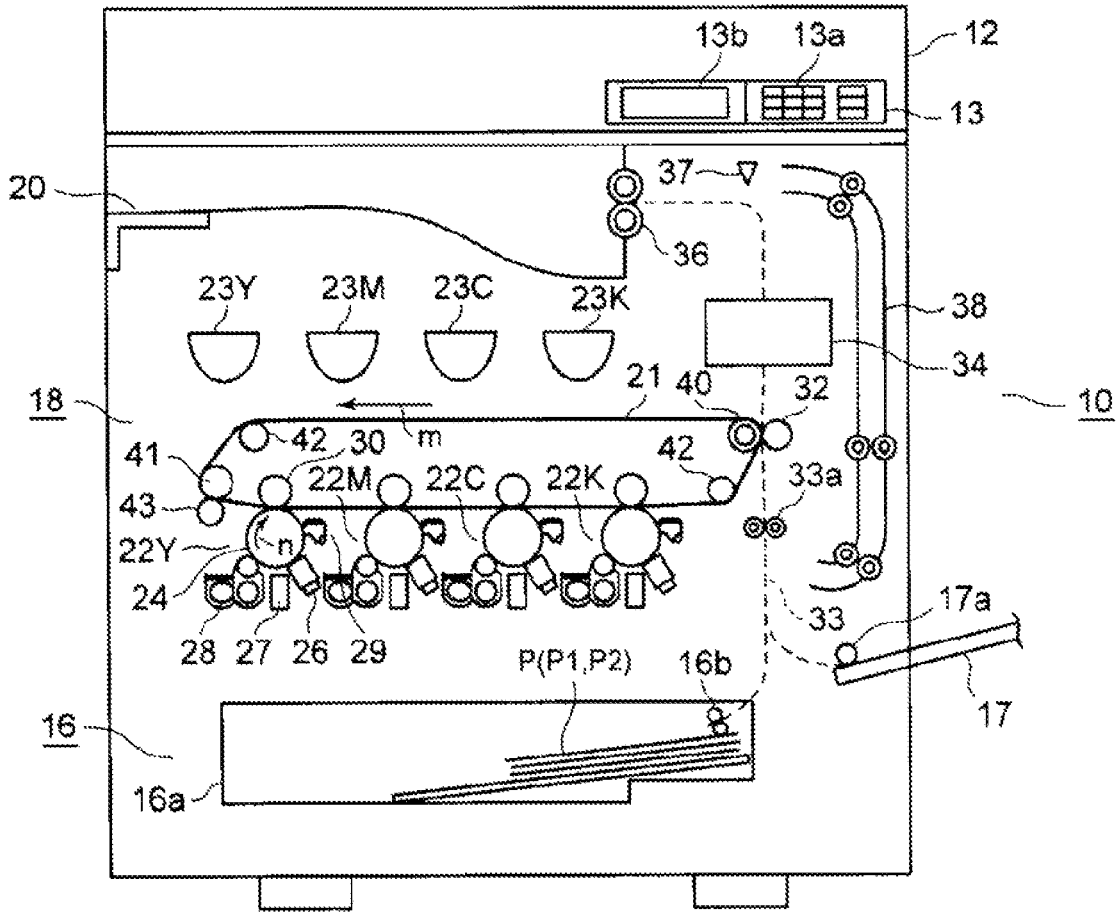
FIG. 1 is a schematic structural view of an image forming device according to an embodiment.

Hereinafter, one embodiment will be described with reference to FIGS. 1 to 4. FIG. 1 shows Multi-Function Peripheral (MFP) 10 that is one example of an image forming device according to the embodiment. The MFP 10 includes, for example, a scanner 12, a control panel 13, a paper feeding cassette unit 16, a paper feeding tray 17, a printer unit 18, and a paper discharge unit 20.

The image forming device is not limited to the MFP 10. The image forming device may be a revolver-type MFP in which a plurality of revolver-type developing units sequentially develop images one photosensitive drum. The number of the developing units is not limited.

The scanner 12 reads an original image for forming an image by the printer unit 18. The control panel 13 includes, for example, an input key 13*a* and a touch panel display 13*b*. The input key 13*a* receives, for example, an input by a user. The display 13*b*, for example, receives an input by a user or displays information to a user.

The paper feeding cassette unit 16 includes a paper feeding cassette 16*a* which accommodates a sheet P, which is a recording medium, and a pickup roller 16*b* which picks up the sheet P from the paper feeding cassette 16*a*. The paper feeding cassette 16*a* may feed an unused sheet P1 or a reused sheet (for example, a sheet on which an image has been erased) P2. The paper feeding tray 17 may feed the unused sheet P1 or the reused sheet P2 with a pickup roller 17*a*.

The printer unit 18 includes an intermediate transfer belt 21, which is an endless belt for the image forming device. In the printer unit 18, the intermediate transfer belt 21 is held by a backup roller 40 including a driving unit, a driven roller 41, and a tension roller 42, and rotates in an arrow direction of m.

The printer unit 18 includes four sets of image forming stations 22Y, 22M, 22C, and 22K for forming images of Y (yellow), M (magenta), C (cyan), and K (black), respectively, which are aligned in parallel under the intermediate transfer belt 21. The printer unit 18 includes supply cartridges 23Y, 23M, 23C, and 23K above the image forming stations 22Y, 22M, 22C, and 22K, respectively.

The supply cartridges 23Y, 23M, 23C, and 23K accommodate supplement toners of Y (yellow), M (magenta), C (cyan), and K (black), respectively.

For example, the image forming station 22Y of Y (yellow) includes an electrification charger 26, an exposure-scanning head 27, a developing unit 28, and a photoreceptor cleaner 29 around a photosensitive drum 24 rotating in an arrow direction of n. The image forming station 22Y of Y (yellow) includes a primary transfer roller 30 opposite to the photosensitive drum 24 across the intermediate transfer belt 21.

Three sets of image forming stations 22M, 22C, and 22K of M (magenta), C (cyan), and K (black), respectively, have the same structure as that of the image forming station 22Y of Y (yellow). The detailed description of the structure of the three sets of image forming stations 22M, 22C, and 22K of M (magenta), C (cyan), and K (black), respectively, is omitted.

After charging the corresponding photosensitive drum 24 with the corresponding electrification charger 26, each of the image forming stations 22Y, 22M, 22C, and 22K forms an electrostatic latent image on the photosensitive drum 24 by the corresponding exposure scanning head 27 that scans the surface of the photosensitive drum 24. The developing unit develops the electrostatic latent image on the photosensitive drum 24, using a developer including two components of toner of Y (yellow), M (magenta), C (cyan), or K (black) and a carrier. As the toner used for development, for example, a non-decolorizable toner may be used, or a decolorizable toner capable of being decolorized, for example, by heating at a predetermined decolorizing temperature or higher may be used.

The decolorizable toner which is decolorized by heating at the decolorizing temperature or higher is made by, for example, adding a coloring agent, a coloring compound, and a developer to a binder resin. When a toner image formed by the decolorizable toner is heated at the predetermined decolorizing temperature or higher, the coloring compound and the developer within the decolorizable toner are dissociated, and hence the toner image is erased. For example, the decolorizable toner may be fixed to the sheet P at a comparatively low temperature and decolorized at a temperature higher than the fixing temperature.

The primary transfer roller 30 primarily transfers the toner image formed on the photosensitive drum 24 to the intermediate transfer belt 21. The respective image forming stations 22Y, 22M, 22C, and 22K sequentially pile the mono-color toner images of Y (yellow), M (magenta), C (cyan), and K (black), on the intermediate transfer belt 21 by the respective primary transfer rollers 30, thereby forming a color toner image. The photoreceptor cleaner 29 removes the toner left on the photosensitive drum 24 after the primary transfer.

The printer unit 18 includes a second transfer roller 32 opposite to the backup roller 40 across the intermediate transfer belt 21. The second transfer roller 32 secondarily transfers the color toner image on the intermediate transfer belt 21 to the sheet P. The sheet P is carried from the paper feeding cassette unit 16 or a manually paper feeding tray 17 along a conveyance path 33, in accordance with the color toner image being conveyed on the intermediate transfer belt 21. The belt cleaner 43 removes the toner left on the intermediate transfer belt 21 after the secondary transfer.

The printer unit 18 includes a resist roller 33*a*, a fixing device 34, and a paper discharge roller 36 along the conveyance path 33. The printer unit 18 includes a branch unit 37 and an inverse conveyor unit 38 downstream with respect to the fixing device 34 in a sheet conveying direction. The branch unit 37 guides the image-fixed sheet P to the paper discharge unit 20 or a reverse conveyor unit 38. In the case of a double-side printing, the reverse conveyor unit 38 conveys the sheet P guided by the branch unit 37 thereto in a direction of the resist roller 33*a*.

According to the above-described structure, the MFP 10 forms a fixed toner image on the sheet P in the printer unit 18 and discharges the sheet P to the paper discharge unit 20.

Figure 2:
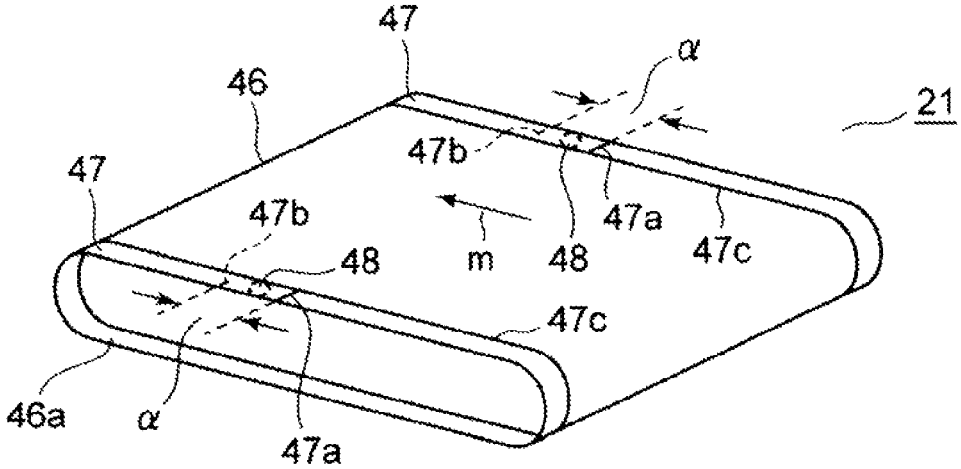
FIG. 2 is a schematic perspective view of an endless belt according to the embodiment.

The intermediate transfer belt 21 will be described in detail. As illustrated in FIG. 2, the intermediate transfer belt 21 includes a belt base member 46 and a reinforcement tape 47. The belt base member 46 is formed of a resin film such as a polyimide resin (for example, PI) or fluorine resin (for example, PFA), a metal foil of copper (Cu) or nickel (Ni), and silicon rubber or other rubber. The belt base member 46 has a single-layer structure or a stacked-layer structure and has flexibility. A volume resistivity of The belt base member 46 may be adjusted to be a desired volume resistivity by blending a conductive filler therein, in order to hold the toner. The belt base member 46 includes a rib 46*a* which regulates a movement of the intermediate transfer belt 21 in an axial direction (a direction vertical to the rotating direction) in an inner periphery of the belt base member 46.

The reinforcement tape 47 is made of, for example, polyester resin (for example, PET), polyimide resin (for example, PI), or fluorine resin (for example, PFA, PTFE, and PVDF). The reinforcement tape 47 has a single-layer or a stacked-layer structure and has flexibility.

The reinforcement tape 47 is adhered to both sides of the belt base member 46 along the rotational direction of the arrow m by a bonding agent or an adhesive agent. For example, when the intermediate transfer belt is provided with a rib only on one side, the reinforcement tape may be provided only on a side of the belt base member 46 that has no rib. The both ends 47*a* and 47*b* of the reinforcement tape 47 overlap with each other in an overlapped portion α. The overlapped portion α of the reinforcement tape 47 is bonded by a weld 48, which is a bonding portion.

Figure 3:
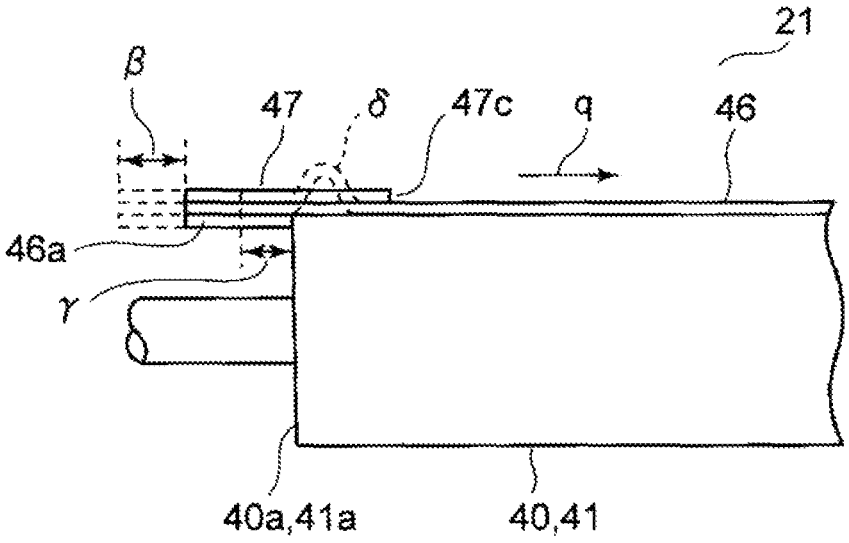
FIG. 3 is a schematic view of reinforcement tape of the endless belt according to the embodiment.

An inner end 47*c* of the reinforcement tape 47 is located inward (close to the center of the belt base member 46 in an axial direction of the backup roller 40 or the driven roller 40) from the respective roller ends 40*a* and 41*a* of the backup roller 40 and the driven roller 41 even when the intermediate transfer belt 21 is deviated by a maximum width β. For example, when the intermediate transfer belt 21 is deviated by the maximum width β, a space γ is created between the roller ends 40*a* and 41*a* and the rib 46*a*, as illustrated in FIG. 3. Then, when the intermediate transfer belt 21 is returned to an arrow direction of q, the belt base member 46 is bent as indicated by a dotted line δ in some cases. The reinforcement tape 47 covers and reinforces an area of the belt base member 46 that may be bent according to the movement of the intermediate transfer belt 21 in the axial direction.

At the weld 48, for example, a plurality of long wiry heaters are inserted in the overlapped portion α of the reinforcement tape 47 and heated, to weld the reinforcement tape 47. Alternatively, the reinforcement tape 47 may be weld by applying a heated iron thereto. In the overlapped portion α of the reinforcement tape 47, rigidity in the weld 48 is higher than that in the periphery of the weld 48.

Figure 4:
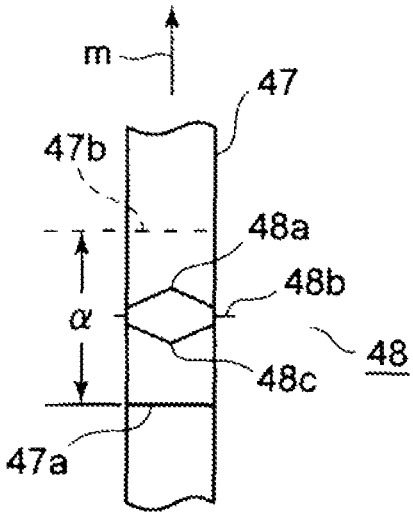
FIG. 4 is a schematic view of an example of a weld formed in the reinforcement tape.
Figure 5A:
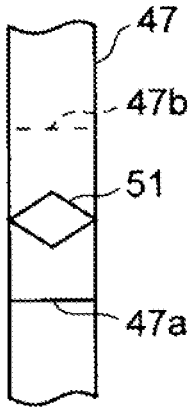
FIGS. 5A, 5B, 5C, and 5D are schematic views of other examples of the weld.
Figure 5B:
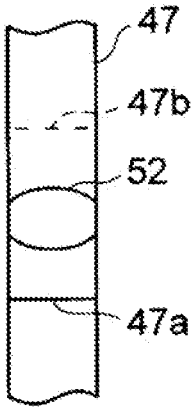
Figure 5C:
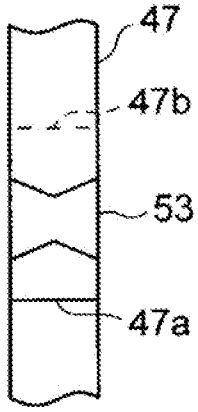
Figure 5D:
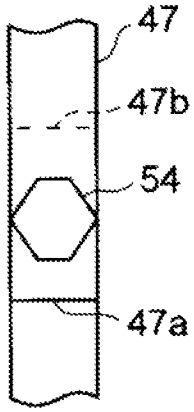

An example of the shape of the weld 48 formed by a plurality of the heaters is shown in FIG. 4. The width of the weld 48 gradually becomes wider toward a center 48*b*, which is the middle portion, from a leading end 48*a* and a trailing end 48*c*, which are the ends in the rotation direction of the arrow m of the intermediate transfer belt 21. As each width of the leading end 48*a* and the trailing end 48*c* of the weld 48 of the reinforcement tape 47 is narrower than the width of the center 48*b*, rigidity of the weld 48 is varied in the overlapped portion α of the reinforcement tape 47.

When the intermediate transfer belt 21 rotates in the arrow direction of m, the overlapped portion α of the reinforcement tape 47 is significantly bent, for example, at the location of the backup roller 40 or the driven roller 41. Therefore, when a change in rigidity in the direction of m is sharp between the weld 48 of the overlapped portion α of the reinforcement tape 47 and the periphery of the weld 48, it can easily cause a crack in a portion of the belt base member 46 corresponding to the end portion of the weld 48 during a repetition of bending and extension of the reinforcement tape 47. According to this embodiment, a change in rigidity between the weld 48 of the overlapped portion α of the reinforcement tape 47 and the periphery of the weld 48 is smaller. This can prevent a crack in the belt base member 46 caused by a change in rigidity during the repetition of bending and extension.

According to a start of printing operation, at the printer unit 18, mono-color toner images are formed respectively in the four sets of image forming stations 22Y, 22M, 22C, and 22K on the respective photosensitive drums 24. The printer unit 18 sequentially superimposes the mono-color toner images of the respective photosensitive drums 24 on the intermediate transfer belt 21 rotated in the arrow direction of m by the respective primary transfer rollers 30, as the primary transfer. After the primary transfer, the respective photoreceptor cleaners 29 clean the toner remaining on the respective photosensitive drums 24. The photosensitive drums 24 are ready for the next printing.

The intermediate transfer belt 21 further rotates in the arrow direction of m and conveys the toner image to the second transfer roller 32. In accordance with the toner image arriving at the location of the second transfer roller 32, the MFP 10 conveys the sheet P from the paper feeding cassette unit 16 or the paper feeding tray 17 to the second transfer roller 32. The second transfer roller 32 performs the secondary transfer of the toner image on the intermediate transfer belt 21 to the sheet P, with a transfer bias.

Then, the fixing device 34 of the MFP 10 fixes the toner image to the sheet P, and the sheet P with the print image fixed thereto is conveyed to the branch unit 37. In the case of double-side printing, the branch unit 37 guides the sheet P in a direction of the reverse conveyor unit 38. The MFP 10 performs the printing operation on the rear surface of the sheet P conveyed from the resist roller 33*a*. In the case of single-side printing, the branch unit 37 guides the sheet P to the paper discharge unit 20, and then the printing operation is finished.

During the printing operation, the overlapped portion α of the reinforcement tape 47 of the intermediate transfer belt 21 rotating in the arrow direction of m is bent largely at the location of the backup roller 40 or the driven roller 41. The width of the weld 48 of the overlapped portion α of the reinforcement tape 47 gradually becomes wider from the leading end 48*a* and the trailing end 48*c* to the center 48*b*, and the rigidity of the weld 48 becomes gradually higher, as compared to the periphery. Even when the overlapped portion α of the reinforcement tape 47 is repeatedly bent or extended, the belt base member 46 cannot be damaged due to a change in the rigidity of the weld 48.

According to the embodiment, the reinforcement tape 47 is attached to the periphery of the belt base member 46, to reinforce the belt base member 46 in a circumferential direction. In the axial direction of the backup roller 40 and the driven roller 41, the inner end 47*c* of the reinforcement tape 47 is disposed inward from the roller ends 40*a* and 41*a*, to reinforce the belt base member 46 also in the axial direction.

According to the embodiment, the width of the weld 48 of the reinforcement tape 47 is gradually widened from the leading end 48*a* or the trailing end 48*c* to the center 48*b*. The rigidity of the weld 48 is gradually varied from the rigidity of the periphery, and hence the belt base member 46 is prevented from being damaged. As a result, a lifetime of the belt base member 46 can be improved.

In the image forming device according to the above-mentioned embodiment, the shape of the weld 48 is not limited to the above-described shape, and any shape may be possible as long as the width of the end is narrower than the width of the center. For example, the shape of the bonding portion may be a diamond-shaped weld 51, an oval-shaped weld 52, an hourglass-shaped weld 53, and a hexagonal shaped weld 54 as shown in FIGS. 5A to 5D, respectively.

Figure 6:
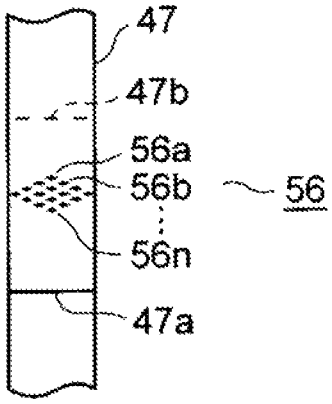
FIG. 6 is a schematic view of another example of the weld.

Further, plural bonding portions may be provided. For example, the problem portion may be formed in a large diamond-shaped weld 56 including small diamond-shaped welds 56*a*, 56*b*, . . . , and 56*n*, as shown in FIG. 6. Each of the small diamond-shaped welds 56*a*, 56*b*, . . . , and 56*n* is formed with a diamond-shaped wiry heater. Alternatively, for example, when the overlapped portion α of the reinforcement tape 47 in the embodiment is long, a plurality of the welds 48 of the embodiment may be provided thereto. Further, when a reinforcement member is formed of a plurality of parts and adhered to the side of the belt base member, the overlapped portions of the plural parts are respectively bonded at the bonding portions. In the respective bonding portions, the width of the end is made narrower than the width of the center.

Further, in the bonding portion, the overlap portion of the reinforcement member may not be weld but may be adhered to each other with a bonding agent (adhesive). When the bonding agent is used to bond the reinforcement member, the width of the end of the bonding agent is made narrower than the width of the center thereof. Further, the endless belt is not limited to the intermediate transfer belt. The endless belt may be, for example, a belt used for a fixing belt, a sheet conveyor belt, or the like of the image forming device.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An endless belt for an image forming device, comprising:

a base member that is shaped in a loop and is to be rotated around a center of the loop; and a reinforcement tape that is attached to a side of the base member, has two ends that are overlapped with each other, and has a bonding portion between the two ends in the overlapped portion, wherein the bonding portion has a polygonal shape and has an outer portion, an inner portion, and a center portion between the inner and outer portions, in a width direction of the reinforcement tape, and a length of the center portion in a rotating direction of the base member is greater than a length of the inner portion and a length of the outer portion, and the bonding portion is formed of a plurality of sub-bonding portions and each of the sub-bonding portions has a polygonal shape.

2. The endless belt according to claim 1, wherein the bonding portion is formed by welding.

3. The endless belt according to claim 1, wherein the length of the portions in a rotating direction of the base member is at a maximum at the center portion.

4. The endless belt according to claim 1, wherein the length of the bonding portion in the rotating direction becomes linearly smaller from the center portion to the outer portion and from the center portion to the inner portion.

5. The endless belt according to claim 1, wherein the inner and outer portions extend to the sides of the reinforcement tape.

6. The endless belt according to claim 1, wherein each of the polygonal shapes of the sub-bonding portion is a quadrilateral shape having a diagonal line extending along the rotating direction of the base member.

7. An endless belt for an image forming device, comprising:

a base member that is shaped in a loop and is to be rotated around a center of the loop;

a reinforcement tape that is attached to a side of the base member, has two ends that are overlapped with each other; and a bonding member that bonds the two ends in the overlapped portion of the reinforcement tape, and that has a polygonal shape and has an outer portion, inner portion, and a center portion between the inner and outer portions, in a width direction of the reinforcement tape, wherein a length of the center portion in a rotating direction of the base member is greater than a length of the inner portion and a length of the outer portion, and the bonding member is formed of a plurality of sub-bonding members and each of the sub-bonding members has a polygonal shape.

8. The endless belt according to claim 7, wherein the bonding member is an adhesive.

9. The endless belt according to claim 7, wherein the length of the portions in a rotating direction of the base member is at a maximum at the center portion.

10. The endless belt according to claim 9, wherein the length of the bonding portion in the rotating direction becomes linearly smaller from the center portion to the outer portion and from the center portion to the inner portion.

11. The endless belt according to claim 7, wherein the inner and outer portions extend to the sides of the reinforcement tape.

12. The endless belt according to claim 7, wherein each of the polygonal shapes of the sub-bonding member is a quadrilateral shape having a diagonal line extending along the rotating direction of the base member.

13. An image forming apparatus, comprising:

an endless belt from which an image is transferred to a recording medium; and an image forming unit configured to form the image onto the endless belt, wherein the endless belt comprises:

a base member that is shaped in a loop and is to be rotated around a center of the loop; and a reinforcement tape that is attached to a side of the base member, has two ends that are overlapped with each other, and has a bonding portion between the two ends in the overlapped portion, the bonding portion has a polygonal shape and has an outer portion, an inner portion, and a center portion between the inner and outer portions, in a width direction of the reinforcement tape, and a length of the center portion in a rotating direction of the base member is smaller than a length of the inner portion and a length of the outer portion.

14. The image forming apparatus according to claim 13, wherein the bonding portion is formed by welding.

15. The image forming apparatus according to claim 13, wherein the length of the portions in a rotating direction of the base member is at a minimum at the center portion.

16. The image forming apparatus according to claim 13, wherein the length of the bonding portion in the rotating direction becomes linearly greater from the center portion to the outer portion and from the center portion to the inner portion.

17. The image forming apparatus according to claim 13, wherein the bonding portion is formed of a plurality of sub-bonding portions, and each of the sub-bonding portions has a quadrilateral shape having a diagonal line extending along the rotating direction of the base member.

18. The image forming apparatus according to claim 13, further comprising:

a roller disposed in the loop of the base member and configured to rotate around a rotational axis, wherein the endless belt is conveyed in accordance with the rotation of the roller, and a part of the reinforcement tape is disposed above a side edge portion of the roller.

* * * * *